US010969717B2

(12) United States Patent
Adachi et al.

(10) Patent No.: US 10,969,717 B2
(45) Date of Patent: Apr. 6, 2021

(54) HEATING DEVICE HAVING A MOTION RESTRICTOR AND FIXING DEVICE AND IMAGE FORMING APPARATUS INCLUDING THE SAME

(71) Applicants: Tomoya Adachi, Kanagawa (JP); Yuusuke Furuichi, Kanagawa (JP); Yukimichi Someya, Saitama (JP); Takayuki Seki, Kanagawa (JP)

(72) Inventors: Tomoya Adachi, Kanagawa (JP); Yuusuke Furuichi, Kanagawa (JP); Yukimichi Someya, Saitama (JP); Takayuki Seki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/736,995

(22) Filed: Jan. 8, 2020

(65) Prior Publication Data

US 2020/0249604 A1 Aug. 6, 2020

(30) Foreign Application Priority Data

Jan. 31, 2019 (JP) ..... JP2019-015972

(51) Int. Cl.
*G03G 15/20* (2006.01)

(52) U.S. Cl.
CPC ..... *G03G 15/2053* (2013.01); *G03G 15/2028* (2013.01); *G03G 15/2064* (2013.01);
(Continued)

(58) Field of Classification Search
CPC ..... G03G 15/2053; G03G 15/2064; G03G 2215/2029; G03G 2215/2022;
(Continued)

(56) References Cited

U.S. PATENT DOCUMENTS

2006/0067751 A1* 3/2006 Gilmore ..... G03G 15/2053 399/329
2010/0296849 A1* 11/2010 Yamamoto ..... G03G 15/657 399/329

(Continued)

FOREIGN PATENT DOCUMENTS

JP 11-052767 2/1999
JP 11052767 A * 2/1999

(Continued)

OTHER PUBLICATIONS

FAQ—Urethanes / Rubbers: MISUMI USA: Industrial Configurable Components Supply. (Aug. 6, 2016). Retrieved Jul. 24, 2020, from https://us.misumi-ec.com/maker/misumi/mech/product/ur/faq/ (Year: 2016).*

(Continued)

*Primary Examiner* — Walter L Lindsay, Jr.
*Assistant Examiner* — Laura Roth
(74) *Attorney, Agent, or Firm* — Harness, Dickey & Pierce, P.L.C.

(57) ABSTRACT

A heating device includes an endless rotator that rotates in a rotation direction and a heater that contacts an inner circumferential surface of the endless rotator and extends in an axial direction of the endless rotator. An elastic body contacts the inner circumferential surface of the endless rotator and is disposed downstream from the heater in the rotation direction of the endless rotator. A holder holds the heater and the elastic body. A pressure rotator is disposed opposite the heater and the elastic body via the endless rotator to form a nip between the endless rotator and the pressure rotator. A motion restrictor is mounted on the holder. The motion restrictor restricts motion of the heater downstream in the rotation direction of the endless rotator.

16 Claims, 9 Drawing Sheets

(52) U.S. Cl.
CPC ..... *G03G 2215/2029* (2013.01); *G03G 2215/2035* (2013.01)

(58) Field of Classification Search
CPC ... G03G 2215/2035; G03G 2215/2041; G03G 15/2028
See application file for complete search history.

(56) References Cited

U.S. PATENT DOCUMENTS

| | | | | |
|---|---|---|---|---|
| 2014/0153983 | A1* | 6/2014 | Fujii ..... | G03G 15/2053 399/329 |
| 2017/0343942 | A1 | 11/2017 | Okamoto et al. | |
| 2018/0203384 | A1 | 7/2018 | Okamoto et al. | |
| 2018/0356755 | A1 | 12/2018 | Hiroi et al. | |
| 2019/0286026 | A1 | 9/2019 | Furuichi et al. | |
| 2019/0286028 | A1 | 9/2019 | Furuichi et al. | |

FOREIGN PATENT DOCUMENTS

| | | | |
|---|---|---|---|
| JP | 2004-206105 | | 7/2004 |
| JP | 2005331576 | A * | 12/2005 |

OTHER PUBLICATIONS

U.S. Appl. No. 16/536,646, filed Aug. 9, 2019 Yuusuke Furuichi.
U.S. Appl. No. 16/535,350, filed Aug. 8, 2019 Yuusuke Furuich, et al.
U.S. Appl. No. 16/502,473, filed Jul. 3, 2019 Yuusuke Furuichi, et al.

* cited by examiner

HEATING DEVICE HAVING A MOTION RESTRICTOR AND FIXING DEVICE AND IMAGE FORMING APPARATUS INCLUDING THE SAME

CROSS-REFERENCE TO RELATED APPLICATION

This patent application is based on and claims priority pursuant to 35 U.S.C. § 119(a) to Japanese Patent Application No. 2019-015972, filed on Jan. 31, 2019, in the Japan Patent Office, the entire disclosure of which is hereby incorporated by reference herein.

BACKGROUND

Technical Field

Exemplary aspects of the present disclosure relate to a heating device, a fixing device, and an image forming apparatus, and more particularly, to a heating device incorporating a resistive heat generator, a fixing device incorporating the heating device, and an image forming apparatus incorporating the fixing device.

Discussion of the Background Art Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses employ fixing devices of various types to fix the image on the recording medium. FIG. 1 illustrates a fixing device 300R as one example of the fixing devices.

The fixing device 300R includes a thin, fixing belt 310R having a decreased thermal capacity. The fixing belt 310R is looped over rollers 301R and 302R. A laminated heater 303R constructed of a base 350R and a resistive heat generator 360R heats an inner circumferential surface of the fixing belt 310R. A stay 330R supports the laminated heater 303R. The laminated heater 303R directly heats the fixing belt 310R at a fixing nip formed between the fixing belt 310R and a pressure roller 320R.

With the fixing device 300R employing the laminated heater 303R, since the laminated heater 303R is platy, the laminated heater 303R may not exert sufficient pressure to toner melted and softened at a downstream half part of the fixing nip in a sheet conveyance direction DR in which a sheet P serving as a recording medium is conveyed. When the fixing device 300R fixes a color toner image on a sheet P, for example, insufficient pressure may cause faulty mixing of colors (e.g., black, yellow, magenta, and cyan) and faulty fixing. To address this circumstance, an elastic body 375R disposed opposite the downstream half part of the fixing nip retains sufficient pressure. However, since the elastic body 375R is disposed downstream from and abutted on the laminated heater 303R, as the laminated heater 303R contacts the fixing belt 310R frictionally, the laminated heater 303R may move to the elastic body 375R easily.

As the laminated heater 303R moves downstream in the sheet conveyance direction DR, the laminated heater 303R may press and deform the elastic body 375R. Accordingly, a deformed portion of the elastic body 375R may exert a pressure greater than a predetermined pressure locally, increasing abrasion of the inner circumferential surface of the fixing belt 31 OR and driving torque of the fixing belt 31 OR, for example. Additionally, if a surface of the elastic body 375R is covered by a slide sheet that reduces friction, an opposed portion of the slide sheet, that is disposed opposite the deformed portion of the elastic body 375R, may be lifted locally, suffering from creases and deformation. Accordingly, the slide sheet may further increase abrasion and driving torque of the fixing belt 310R.

SUMMARY

This specification describes below an improved heating device. In one embodiment, the heating device includes an endless rotator that rotates in a rotation direction and a heater that contacts an inner circumferential surface of the endless rotator and extends in an axial direction of the endless rotator. An elastic body contacts the inner circumferential surface of the endless rotator and is disposed downstream from the heater in the rotation direction of the endless rotator. A holder holds the heater and the elastic body. A pressure rotator is disposed opposite the heater and the elastic body via the endless rotator to form a nip between the endless rotator and the pressure rotator. A motion restrictor is mounted on the holder. The motion restrictor restricts motion of the heater downstream in the rotation direction of the endless rotator.

This specification further describes an improved fixing device. In one embodiment, the fixing device includes an endless rotator that rotates in a rotation direction and a heater that contacts an inner circumferential surface of the endless rotator and extends in an axial direction of the endless rotator. An elastic body contacts the inner circumferential surface of the endless rotator and is disposed downstream from the heater in the rotation direction of the endless rotator. A holder holds the heater and the elastic body. A pressure rotator is disposed opposite the heater and the elastic body via the endless rotator to form a nip between the endless rotator and the pressure rotator, through which a recording medium bearing a developer is conveyed. A motion restrictor is mounted on the holder. The motion restrictor restricts motion of the heater downstream in the rotation direction of the endless rotator.

This specification further describes an improved image forming apparatus. In one embodiment, the image forming apparatus includes an image forming device that forms an image and a fixing device that fixes the image on a recording medium. The fixing device includes an endless rotator that rotates in a rotation direction and a heater that contacts an inner circumferential surface of the endless rotator and extends in an axial direction of the endless rotator. An elastic body contacts the inner circumferential surface of the endless rotator and is disposed downstream from the heater in the rotation direction of the endless rotator. A holder holds the heater and the elastic body. A pressure rotator is disposed opposite the heater and the elastic body via the endless rotator to form a nip between the endless rotator and the pressure rotator, through which the recording medium bearing the image is conveyed. A motion restrictor is mounted on the holder. The motion restrictor restricts motion of the heater downstream in the rotation direction of the endless rotator.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
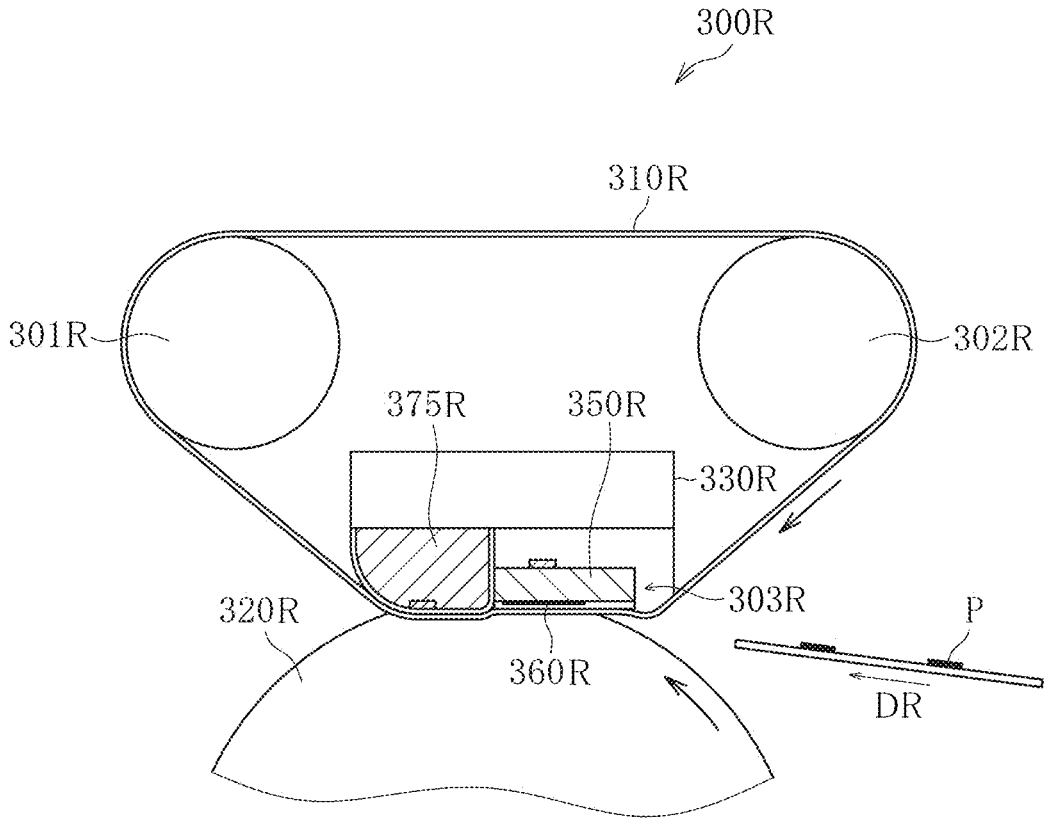
FIG. 1 RELATED ART
FIG. 1 is a cross-sectional view of a related art fixing device.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of a construction of a heating device, a fixing device incorporating the heating device, and an image forming apparatus (e.g., a laser printer) incorporating the fixing device according to embodiments of the present disclosure.

A laser printer is one example of the image forming apparatus. The image forming apparatus is not limited to the laser printer. For example, the image forming apparatus may be a copier, a facsimile machine, a printer, a printing machine, an inkjet recording apparatus, or a multifunction peripheral (MFP) having at least two of copying, facsimile, printing, scanning, and inkjet recording functions.

In the drawings, identical reference numerals are assigned to identical elements and equivalents and redundant descriptions of the identical elements and the equivalents are summarized or omitted properly. The dimension, material, shape, relative position, and the like of each of the elements are examples and do not limit the scope of this disclosure unless otherwise specified.

According to the embodiments below, a sheet is used as a recording medium.

However, the recording medium is not limited to paper as the sheet. In addition to paper as the sheet, the recording medium includes an overhead projector (OHP) transparency, cloth, a metal sheet, plastic film, and a prepreg sheet pre-impregnated with resin in carbon fiber.

The recording medium also includes a medium adhered with a developer and ink, recording paper, and a recording sheet. The sheet includes, in addition to plain paper, thick paper, a postcard, an envelope, thin paper, coated paper, art paper, and tracing paper.

Image formation described below denotes forming an image having meaning such as characters and figures and an image not having meaning such as patterns on the medium.

A description is provided of a construction of a laser printer as an image forming apparatus 100.

Figure 2A:
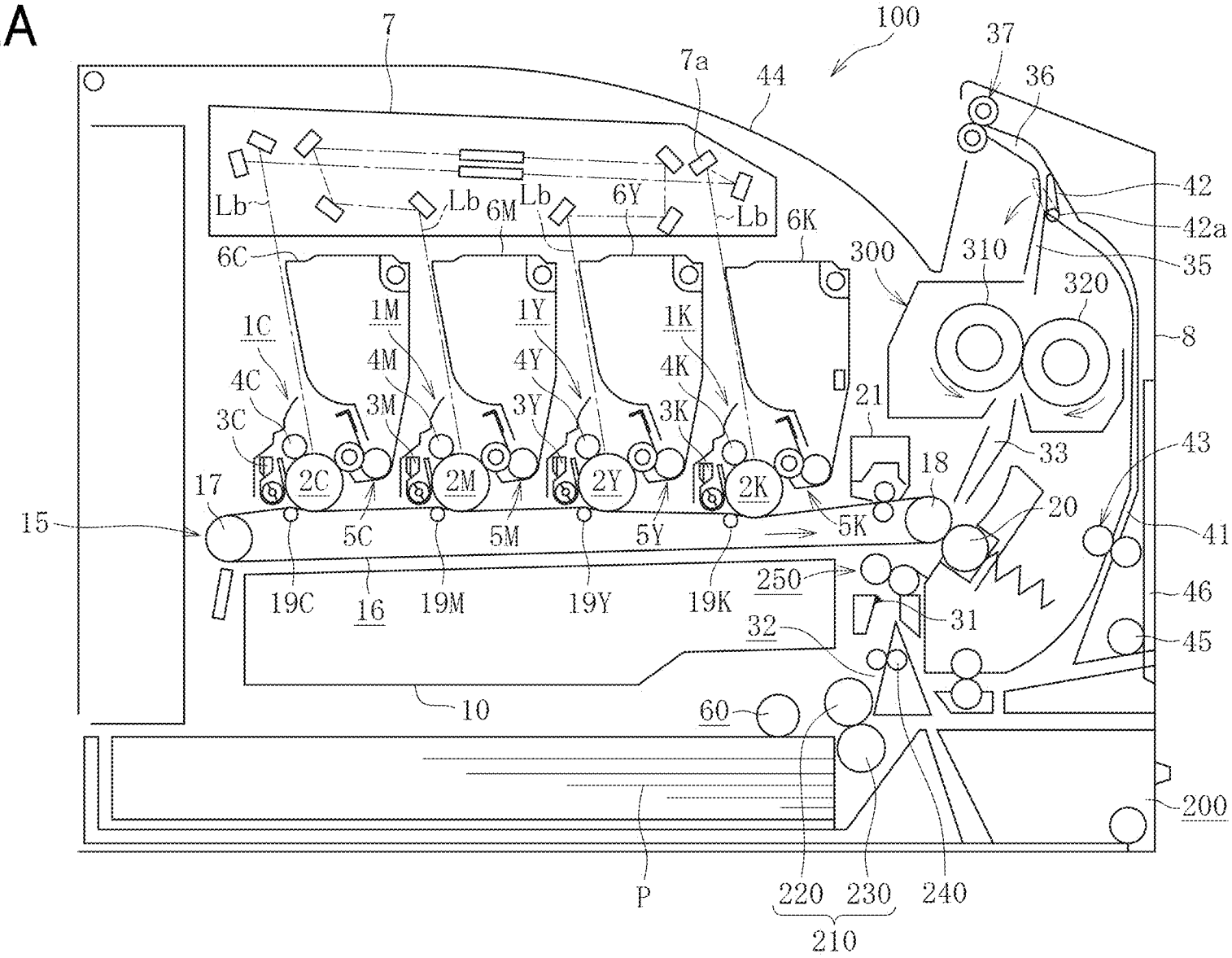
FIG. 2A is a schematic cross-sectional view of an image forming apparatus according to an embodiment of the present disclosure.
Figure 2B:
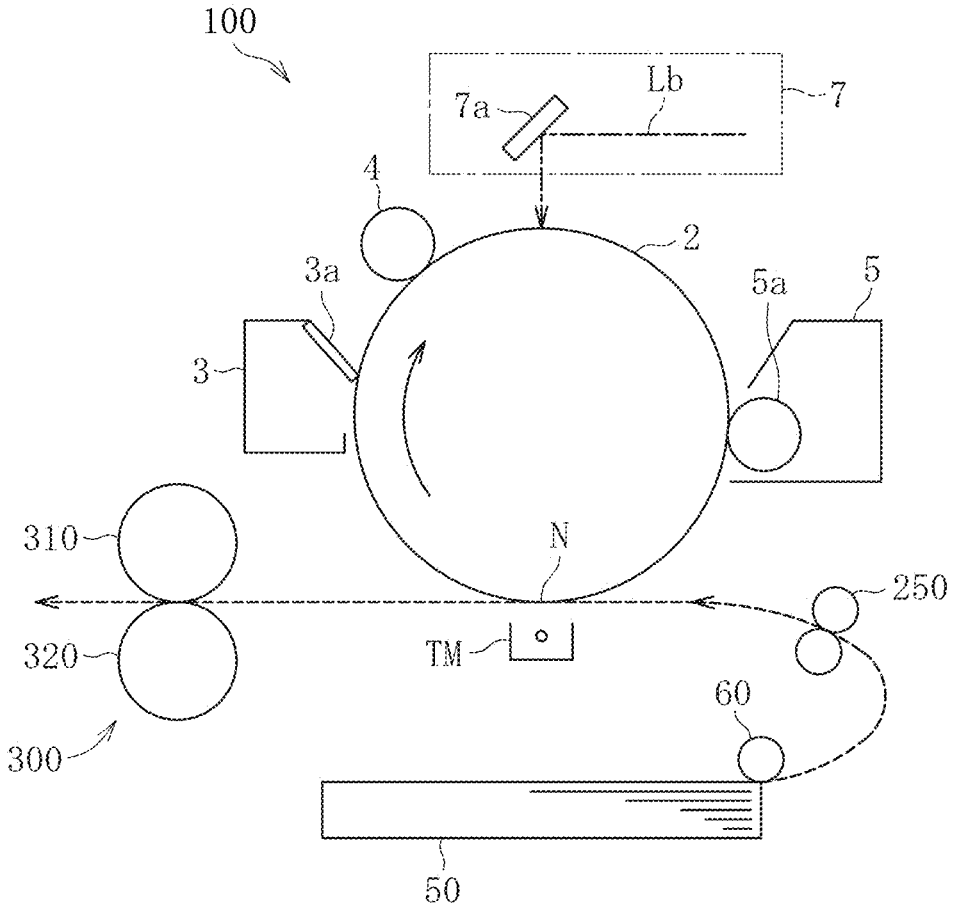
FIG. 2B is a schematic cross-sectional view of the image forming apparatus depicted in FIG. 2A, illustrating a principle thereof.

FIG. 2A is a schematic cross-sectional view of the image forming apparatus 100 that incorporates a heating device or a fixing device 300 according to the embodiments of the present disclosure. FIG. 2A schematically illustrates a construction of a color laser printer as one embodiment of the image forming apparatus 100. FIG. 2B is a schematic cross-sectional view of the image forming apparatus 100, illustrating and simplifying a principle or a mechanism of the color laser printer.

As illustrated in FIG. 2A, the image forming apparatus 100 includes four process units 1K, 1Y, 1M, and 1C serving as image forming devices, respectively. The process units 1K, 1Y, 1M, and 1C form black, yellow, magenta, and cyan toner images with developers in black (K), yellow (Y), magenta (M), and cyan (C), respectively, which correspond to color separation components for a color image.

The process units 1K, 1Y, 1M, and 1C have a common construction except that the process units 1K, 1Y, 1M, and 1C include toner bottles 6K, 6Y, 6M, and 6C containing fresh toners in different colors, respectively. Hence, the following describes a construction of a single process unit, that is, the process unit 1K, and a description of a construction of each of other process units, that is, the process units 1Y, 1M, and 1C, is omitted.

The process unit 1K includes an image bearer 2K (e.g., a photoconductive drum), a drum cleaner 3K, and a discharger. The process unit 1K further includes a charger 4K and a developing device 5K. The charger 4K serves as a charging member or a charging device that uniformly charges a surface of the image bearer 2K. The developing device 5K serves as a developing member that develops an electrostatic latent image formed on the image bearer 2K into a visible image. The process unit 1K is detachably attached to a body of the image forming apparatus 100 to replace consumables of the process unit 1K with new ones. Similarly, the process units 1Y, 1M, and 1C include image bearers 2Y, 2M, and 2C, drum cleaners 3Y, 3M, and 3C, chargers 4Y, 4M, and 4C, and developing devices 5Y, 5M, and 5C, respectively. In FIG. 2B, the image bearers 2K, 2Y, 2M, and 2C, the drum cleaners 3K, 3Y, 3M, and 3C, the chargers 4K, 4Y, 4M, and 4C, and the developing devices 5K, 5Y, 5M, and 5C are indicated as an image bearer 2, a drum cleaner 3, a charger 4, and a developing device 5, respectively.

An exposure device 7 is disposed above the process units 1K, 1Y, 1M, and 1C disposed inside the image forming apparatus 100. The exposure device 7 performs scanning and writing according to image data. For example, the exposure device 7 includes a laser diode that emits a laser beam Lb according to the image data and a mirror 7*a* that reflects the laser beam Lb to the image bearer 2K so that the laser beam Lb irradiates the image bearer 2K.

According to this embodiment, a transfer device 15 is disposed below the process units 1K, 1Y, 1M, and 1C. The transfer device 15 is equivalent to a transferor TM depicted in FIG. 2B. Primary transfer rollers 19K, 19Y, 19M, and 19C are disposed opposite the image bearers 2K, 2Y, 2M, and 2C, respectively, and in contact with an intermediate transfer belt 16.

The intermediate transfer belt 16 rotates in a state in which the intermediate transfer belt 16 is looped over the primary transfer rollers 19K, 19Y, 19M, and 19C, a driving roller 18, and a driven roller 17. A secondary transfer roller 20 is disposed opposite the driving roller 18 and in contact with the intermediate transfer belt 16. The image bearers 2K, 2Y, 2M, and 2C serve as primary image bearers that bear black, yellow, magenta, and cyan toner images, respectively. The intermediate transfer belt 16 serves as a secondary image bearer that bears a composite toner image (e.g., a color toner image) formed with the black, yellow, magenta, and cyan toner images.

A belt cleaner 21 is disposed downstream from the secondary transfer roller 20 in a rotation direction of the intermediate transfer belt 16. A cleaning backup roller is disposed opposite the belt cleaner 21 via the intermediate transfer belt 16.

A sheet feeder 200 including a tray 50 depicted in FIG. 2B that loads sheets P is disposed in a lower portion of the image forming apparatus 100. The sheet feeder 200 serves as a recording medium supply that contains a plurality of sheets P in a substantial number, that is, a sheaf of sheets P, serving as recording media. The sheet feeder 200 is combined with a sheet feeding roller 60 and a roller pair 210 into a unit. The sheet feeding roller 60 and the roller pair 210 serve as separation-conveyance members that separate an uppermost sheet P from other sheets P and convey the uppermost sheet P.

The sheet feeder 200 is inserted into and removed from the body of the image forming apparatus 100 for replenishment and the like of the sheets P. The sheet feeding roller 60 and the roller pair 210 are disposed above the sheet feeder 200 and convey the uppermost sheet P of the sheaf of sheets P placed in the sheet feeder 200 toward a sheet feeding path 32.

A registration roller pair 250 serving as a conveyer is disposed immediately upstream from the secondary transfer roller 20 in a sheet conveyance direction. The registration roller pair 250 temporarily halts the sheet P sent from the sheet feeder 200. As the registration roller pair 250 temporarily halts the sheet P, the registration roller pair 250 slacks a leading end of the sheet P, correcting skew of the sheet P.

A registration sensor 31 is disposed immediately upstream from the registration roller pair 250 in the sheet conveyance direction. The registration sensor 31 detects passage of the leading end of the sheet P. When a predetermined time period elapses after the registration sensor 31 detects passage of the leading end of the sheet P, the sheet P strikes the registration roller pair 250 and halts temporarily.

Downstream from the sheet feeder 200 in the sheet conveyance direction is a conveying roller 240 that conveys the sheet P conveyed rightward from the roller pair 210 upward. As illustrated in FIG. 2A, the conveying roller 240 conveys the sheet P upward toward the registration roller pair 250.

The roller pair 210 is constructed of a pair of rollers, that is, an upper roller and a lower roller. The roller pair 210 employs a friction reverse roller (FRR) separation system or a friction roller (FR) separation system. According to the FRR separation system, a separating roller (e.g., a reverse roller) is applied with a torque in a predetermined amount in an anti-feeding direction by a driving shaft through a torque limiter. The separating roller is pressed against a feeding roller to form a nip therebetween where the uppermost sheet P is separated from other sheets P. According to the FR separation system, a separating roller (e.g., a friction roller) is supported by a securing shaft via a torque limiter. The separating roller is pressed against a feeding roller to form a nip therebetween where the uppermost sheet P is separated from other sheets P.

According to this embodiment, the roller pair 210 employs the FRR separation system. For example, the roller pair 210 includes a feeding roller 220 and a separating roller 230. The feeding roller 220 is an upper roller that conveys the sheet P to an inside of a machine. The separating roller 230 is a lower roller that is applied with a driving force in a direction opposite a rotation direction of the feeding roller 220 by a driving shaft through a torque limiter.

A biasing member such as a spring biases the separating roller 230 against the feeding roller 220. The driving force applied to the feeding roller 220 is transmitted to the sheet feeding roller 60 through a clutch, thus rotating the sheet feeding roller 60 counterclockwise in FIG. 2A.

After the leading end of the sheet P strikes the registration roller pair 250 and slacks, the registration roller pair 250 conveys the sheet P to a secondary transfer nip (e.g., a transfer nip N depicted in FIG. 2B) formed between the secondary transfer roller 20 and the intermediate transfer belt 16 pressed by the driving roller 18 at a proper time when the secondary transfer roller 20 transfers a color toner image formed on the intermediate transfer belt 16 onto the sheet P. A bias applied at the secondary transfer nip electrostatically transfers the color toner image formed on the intermediate transfer belt 16 onto a desired transfer position on the sheet P sent to the secondary transfer nip precisely.

A post-transfer conveyance path 33 is disposed above the secondary transfer nip formed between the secondary transfer roller 20 and the intermediate transfer belt 16 pressed by the driving roller 18. The fixing device 300 is disposed in proximity to an upper end of the post-transfer conveyance path 33. The fixing device 300 includes a fixing belt 310 and a pressure roller 320. The fixing belt 310 is tubular and serves as an endless rotator or a rotator that accommodates a heater. The pressure roller 320 serves as a pressure rotator or a pressure member that rotates while the pressure roller 320 contacts an outer circumferential surface of the fixing belt 310 with predetermined pressure.

As illustrated in FIG. 2A, a post-fixing conveyance path 35 is disposed above the fixing device 300. At an upper end of the post-fixing conveyance path 35, the post-fixing conveyance path 35 branches to a sheet ejection path 36 and a reverse conveyance path 41. A switcher 42 is disposed at a bifurcation of the post-fixing conveyance path 35. The switcher 42 pivots about a pivot shaft 42*a* as an axis. A sheet ejection roller pair 37 is disposed in proximity to an outlet edge of the sheet ejection path 36.

One end of the reverse conveyance path 41 is at the bifurcation of the post-fixing conveyance path 35. Another end of the reverse conveyance path 41 joins the sheet feeding path 32. A reverse conveyance roller pair 43 is disposed in a middle of the reverse conveyance path 41. A sheet ejection tray 44 is disposed in an upper portion of the image forming apparatus 100. The sheet ejection tray 44 includes a recess directed inward in the image forming apparatus 100.

A powder container 10 (e.g., a toner container) is interposed between the transfer device 15 and the sheet feeder 200. The powder container 10 is detachably attached to the body of the image forming apparatus 100.

The image forming apparatus 100 according to this embodiment secures a predetermined distance from the sheet feeding roller 60 to the secondary transfer roller 20 to convey the sheet P. Hence, the powder container 10 is situated in a dead space defined by the predetermined distance, downsizing the image forming apparatus 100 entirely.

A transfer cover 8 is disposed above the sheet feeder 200 at a front of the image forming apparatus 100 in a drawing direction of the sheet feeder 200. As an operator (e.g., a user and a service engineer) opens the transfer cover 8, the operator inspects an inside of the image forming apparatus 100. The transfer cover 8 mounts a bypass tray 46 and a bypass sheet feeding roller 45 used for a sheet P manually placed on the bypass tray 46 by the operator.

A description is provided of operations of the image forming apparatus 100, that is, the laser printer.

Referring to FIG. 2A, the following describes basic operations of the image forming apparatus 100 according to this embodiment, which has the construction described above to perform image formation.

First, a description is provided of operations of the image forming apparatus 100 to print on one side of a sheet P.

As illustrated in FIG. 2A, the sheet feeding roller 60 rotates according to a sheet feeding signal sent from a controller of the image forming apparatus 100. The sheet feeding roller 60 separates an uppermost sheet P from other sheets P of a sheaf of sheets P loaded in the sheet feeder 200 and feeds the uppermost sheet P to the sheet feeding path 32.

When the leading end of the sheet P sent by the sheet feeding roller 60 and the roller pair 210 reaches a nip of the registration roller pair 250, the registration roller pair 250 slacks and halts the sheet P temporarily. The registration roller pair 250 conveys the sheet P to the secondary transfer nip at an optimal time in synchronism with a time when the secondary transfer roller 20 transfers a color toner image formed on the intermediate transfer belt 16 onto the sheet P while the registration roller pair 250 corrects skew of the leading end of the sheet P.

In order to feed a sheaf of sheets P placed on the bypass tray 46, the bypass sheet feeding roller 45 conveys the sheaf of sheets P loaded on the bypass tray 46 one by one from an uppermost sheet P. The sheet P is conveyed through a part of the reverse conveyance path 41 to the nip of the registration roller pair 250. Thereafter, the sheet P is conveyed similarly to the sheet P conveyed from the sheet feeder 200.

The following describes processes for image formation with one process unit, that is, the process unit 1K, and a description of processes for image formation with other process units, that is, the process units 1Y, 1M, and 1C, is omitted. First, the charger 4K uniformly charges the surface of the image bearer 2K at a high electric potential. The exposure device 7 emits a laser beam Lb that irradiates the surface of the image bearer 2K according to image data.

The electric potential of an irradiated portion on the surface of the image bearer 2K, which is irradiated with the laser beam Lb, decreases, forming an electrostatic latent image on the image bearer 2K. The developing device 5K includes a developer bearer 5*a* depicted in FIG. 2B that bears a developer containing toner. Fresh black toner supplied from the toner bottle 6K is transferred onto a portion on the surface of the image bearer 2K, which bears the electrostatic latent image, through the developer bearer 5*a*.

The surface of the image bearer 2K transferred with the black toner bears a black toner image developed with the black toner. The primary transfer roller 19K transfers the black toner image formed on the image bearer 2K onto the intermediate transfer belt 16.

A cleaning blade 3*a* depicted in FIG. 2B of the drum cleaner 3K removes residual toner failed to be transferred onto the intermediate transfer belt 16 and therefore adhered on the surface of the image bearer 2K therefrom. The removed residual toner is conveyed by a waste toner conveyer and collected into a waste toner container disposed inside the process unit 1K. The discharger removes residual electric charge from the image bearer 2K from which the drum cleaner 3K has removed the residual toner.

Similarly, in the process units 1Y, 1M, and 1C, yellow, magenta, and cyan toner images are formed on the image bearers 2Y, 2M, and 2C, respectively. The primary transfer rollers 19Y, 19M, and 19C transfer the yellow, magenta, and cyan toner images formed on the image bearers 2Y, 2M, and 2C, respectively, onto the intermediate transfer belt 16 such that the yellow, magenta, and cyan toner images are superimposed on the intermediate transfer belt 16.

The black, yellow, magenta, and cyan toner images transferred and superimposed on the intermediate transfer belt 16 travel to the secondary transfer nip formed between the secondary transfer roller 20 and the intermediate transfer belt 16 pressed by the driving roller 18. On the other hand, the registration roller pair 250 resumes rotation at a predetermined time while sandwiching a sheet P that strikes the registration roller pair 250. The registration roller pair 250 conveys the sheet P to the secondary transfer nip formed between the secondary transfer roller 20 and the intermediate transfer belt 16 at a time when the secondary transfer roller 20 transfers the black, yellow, magenta, and cyan toner images superimposed on the intermediate transfer belt 16 properly. Thus, the secondary transfer roller 20 transfers the black, yellow, magenta, and cyan toner images superimposed on the intermediate transfer belt 16 onto the sheet P conveyed by the registration roller pair 250, forming a color toner image on the sheet P.

The sheet P transferred with the color toner image is conveyed to the fixing device 300 through the post-transfer conveyance path 33. The fixing belt 310 and the pressure roller 320 sandwich the sheet P conveyed to the fixing device 300 and fix the unfixed color toner image on the sheet P under heat and pressure. The sheet P bearing the fixed color toner image is conveyed from the fixing device 300 to the post-fixing conveyance path 35.

When the sheet P is sent out of the fixing device 300, the switcher 42 opens the upper end of the post-fixing conveyance path 35 and a vicinity thereof as illustrated with a solid line in FIG. 2A. The sheet P sent out of the fixing device 300 is conveyed to the sheet ejection path 36 through the post-fixing conveyance path 35. The sheet ejection roller pair 37 sandwiches the sheet P sent to the sheet ejection path 36 and is driven and rotated to eject the sheet P onto the sheet ejection tray 44, thus finishing printing on one side of the sheet P.

Next, a description is provided of operations of the image forming apparatus 100 to perform duplex printing.

Similarly to printing on one side of the sheet P, the fixing device 300 sends out the sheet P to the sheet ejection path 36. In order to perform duplex printing, the sheet ejection roller pair 37 is driven and rotated to convey a part of the sheet P to an outside of the image forming apparatus 100.

When a trailing end of the sheet P has passed through the sheet ejection path 36, the switcher 42 pivots about the pivot shaft 42*a* as illustrated with a dotted line in FIG. 2A, closing the upper end of the post-fixing conveyance path 35. Approximately simultaneously with closing of the upper end of the post-fixing conveyance path 35, the sheet ejection roller pair 37 rotates in a direction opposite a direction in which the sheet ejection roller pair 37 conveys the sheet P onto the outside of the image forming apparatus 100, thus conveying the sheet P to the reverse conveyance path 41.

The sheet P conveyed to the reverse conveyance path 41 travels to the registration roller pair 250 through the reverse conveyance roller pair 43. The registration roller pair 250 conveys the sheet P to the secondary transfer nip at a proper time when the secondary transfer roller 20 transfers black, yellow, magenta, and cyan toner images superimposed on the intermediate transfer belt 16 onto a back side of the sheet P, which is transferred with no toner image, that is, in synchronism with reaching of the black, yellow, magenta, and cyan toner images to the secondary transfer nip.

While the sheet P passes through the secondary transfer nip, the secondary transfer roller 20 and the driving roller 18 transfer the black, yellow, magenta, and cyan toner images onto the back side of the sheet P, which is transferred with no toner image, thus forming a color toner image on the sheet P. The sheet P transferred with the color toner image is conveyed to the fixing device 300 through the post-transfer conveyance path 33.

In the fixing device 300, the fixing belt 310 and the pressure roller 320 sandwich the sheet P conveyed to the fixing device 300 and fix the unfixed color toner image on the back side of the sheet P under heat and pressure. The sheet P bearing the color toner image fixed on both sides, that is, a front side and the back side of the sheet P, is conveyed from the fixing device 300 to the post-fixing conveyance path 35.

When the sheet P is sent out of the fixing device 300, the switcher 42 opens the upper end of the post-fixing conveyance path 35 and the vicinity thereof as illustrated with the solid line in FIG. 2A. The sheet P sent out of the fixing device 300 is conveyed to the sheet ejection path 36 through the post-fixing conveyance path 35. The sheet ejection roller pair 37 sandwiches the sheet P sent to the sheet ejection path 36 and is driven and rotated to eject the sheet P onto the sheet ejection tray 44, thus finishing duplex printing on the sheet P.

After the secondary transfer roller 20 transfers the black, yellow, magenta, and cyan toner images superimposed on the intermediate transfer belt 16 onto the sheet P, residual toner adheres to the intermediate transfer belt 16. The belt cleaner 21 removes the residual toner from the intermediate transfer belt 16. The residual toner removed from the intermediate transfer belt 16 is conveyed by the waste toner conveyer and collected into the powder container 10.

A description is provided of a construction of each of a heating device 304 and the fixing device 300 according to embodiments of the present disclosure.

Figure 3:
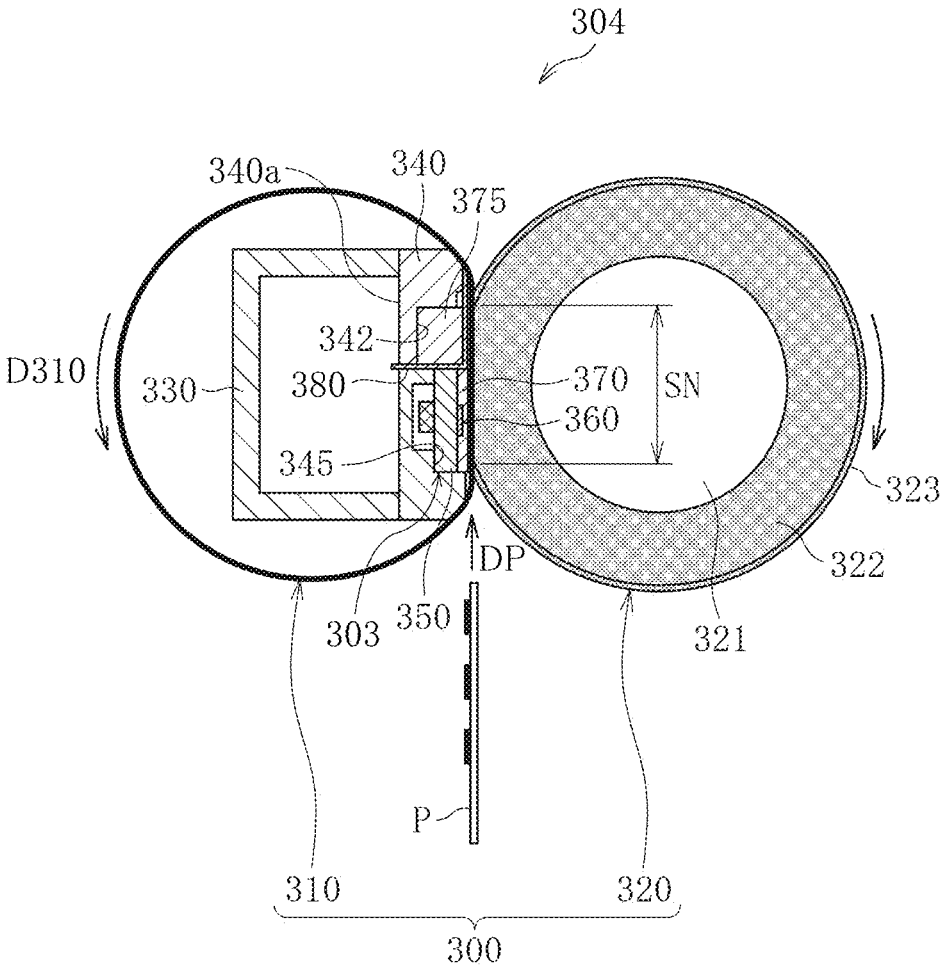
FIG. 3 is a cross-sectional view of a fixing device incorporated in the image forming apparatus depicted in FIG. 2A.

As illustrated in FIG. 3, the heating device 304 has a construction equivalent to a construction of the fixing device 300. The fixing device 300 or the heating device 304 includes a heater 303 that heats the fixing belt 310.

As illustrated in FIG. 3, the fixing device 300 includes the fixing belt 310 that is thin and tubular and has a decreased thermal capacity and the pressure roller 320. As a sheet P that bears a toner image and is conveyed in a sheet conveyance direction DP passes through a fixing nip SN formed between the fixing belt 310 and the pressure roller 320, the fixing belt 310 and the pressure roller 320 sandwich the sheet P and fix the toner image on the sheet P under heat. While the fixing belt 310 rotates in a rotation direction D310 and slides over an insulating layer 370 covering heat generators 360, the heat generators 360 heat the fixing belt 310.

A detailed description is now given of a construction of the fixing belt 310.

The fixing belt 310 includes a tubular base that is made of polyimide (PI) and has an outer diameter of 25 mm and a thickness in a range of from 50 micrometers to 70 micrometers, for example. The fixing belt 310 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 micrometers to 20 micrometers to enhance durability of the fixing belt 310 and facilitate separation of the sheet P and a foreign substance from the fixing belt 310. Optionally, an elastic layer that is made of rubber or the like and has a thickness in a range of from 100 micrometers to 300 micrometers may be interposed between the base and the release layer.

The base of the fixing belt 310 may be made of heat resistant resin such as polyetheretherketone (PEEK) or metal such as nickel (Ni) and SUS stainless steel, instead of polyimide. An inner circumferential surface of the fixing belt 310 may be coated with polyimide, PTFE, or the like to produce a slide layer. The tubular base made of SUS stainless steel achieves sufficient strength even with a thickness in a range of from 20 micrometers to 40 micrometers.

A detailed description is now given of a construction of the pressure roller 320.

The pressure roller 320 has an outer diameter of 25 mm, for example. The pressure roller 320 includes a cored bar 321, an elastic layer 322, and a release layer 323. The cored bar 321 is solid and made of metal such as iron. The elastic layer 322 coats the cored bar 321. The release layer 323 coats an outer surface of the elastic layer 322. The elastic layer 322 is made of silicone rubber and has a thickness of 3.5 mm, for example.

In order to facilitate separation of the sheet P and the foreign substance from the pressure roller 320, the release layer 323 that is made of fluororesin and has a thickness of about 40 micrometers, for example, is preferably disposed on the outer surface of the elastic layer 322. A biasing member presses the pressure roller 320 against the fixing belt 310.

A stay 330 serving as a support and a holder 340 serving as a holder are disposed inside a loop formed by the fixing belt 310 and extended in an axial direction of the fixing belt 310. The stay 330 includes a channel made of metal. Both lateral ends of the stay 330 in a longitudinal direction thereof are supported by side plates of the heating device 304, respectively. The stay 330 receives pressure from the pressure roller 320 precisely to form the fixing nip SN stably.

The holder 340 includes a recess 345 (e.g., a groove) that accommodates and holds a base 350 of the heater 303. The stay 330 supports a rear face 340*a* of the holder 340. The rear face 340*a* faces the stay 330. The holder 340 is preferably made of heat resistant resin having a decreased thermal conductivity, such as liquid crystal polymer (LCP). Accordingly, the holder 340 reduces conduction of heat thereto, improving heating of the fixing belt 310.

In order to prevent contact with a high temperature portion of the base 350, the holder 340 has a shape that supports the base 350 at two positions in proximity to both ends of the base 350, respectively, in a short direction thereof. Accordingly, the holder 340 reduces conduction of heat thereto further, improving heating of the fixing belt 310.

Figure 4A:
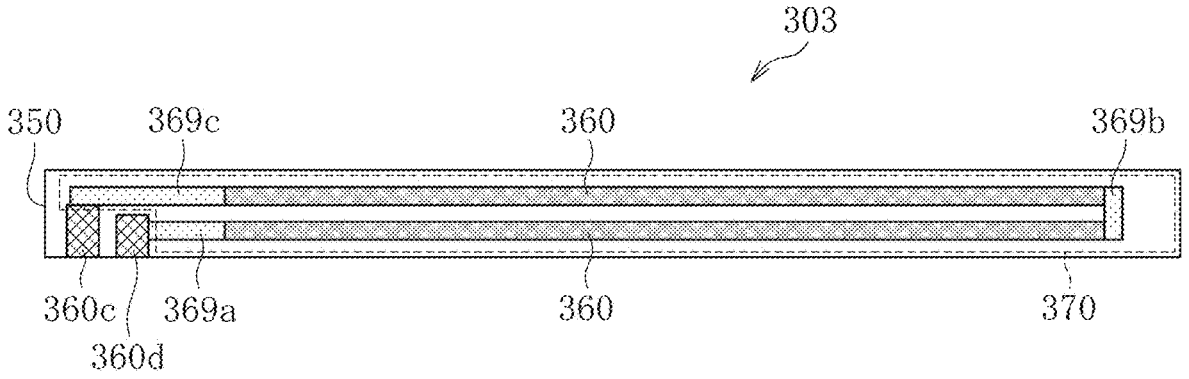
FIG. 4A is a plan view of a heater incorporated in the fixing device depicted in FIG. 3.
Figure 4B:
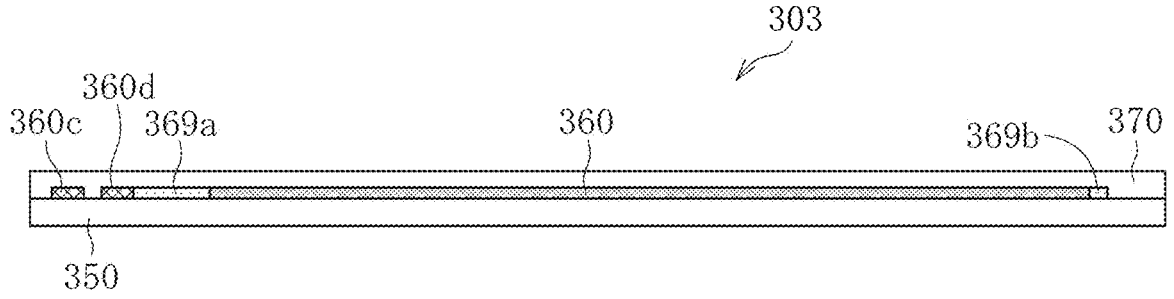
FIG. 4B is a cross-sectional view of the heater depicted in FIG. 4A.

The heater 303 (e.g., a laminated heater) includes the heat generators 360 (e.g., resistive heat generators). As illustrated in FIGS. 4A and 4B, the heat generators 360 are mounted on the base 350. The base 350 includes an elongate, thin metal plate and an insulator that coats the metal plate.

The base 350 is preferably made of aluminum, stainless steel, or the like that is available at reduced costs. Alternatively, instead of metal, the base 350 may be made of ceramic such as alumina and aluminum nitride or a nonmetallic material that has an increased heat resistance and an increased insulation such as glass and mica.

In order to improve evenness of heat generated by the heater 303 so as to enhance quality of an image formed on a sheet P, the base 350 may be made of a material that has an increased thermal conductivity such as copper, graphite, and graphene. According to this embodiment, the base 350 is made of alumina and has a short width of 8 mm, a longitudinal width of 270 mm, and a thickness of 1.0 mm.

As illustrated in FIG. 4A, specifically, the heat generators 360 mounted on the base 350 are extended linearly in a longitudinal direction of the base 350 and are arranged in series and in two lines in parallel to each other. One lateral end of one of the heat generators 360 arranged in two lines is connected to an electrode 360*c* through a feeder 369*c*. One lateral end of another one of the heat generators 360 is connected to an electrode 360*d* through a feeder 369*a*. The feeders 369*a* and 369*c*, having a decreased resistance value, are disposed on one lateral end of the base 350 and extended in the longitudinal direction of the base 350. The electrodes 360*c* and 360*d* supply power to the heat generators 360, respectively. The electrodes 360*c* and 360*d* are coupled to a power supply including an alternating current power supply.

Another lateral end of one of the heat generators 360 is connected to another lateral end of another one of the heat generators 360 through a feeder 369*b* such that one of the heat generators 360, that extends in the longitudinal direction of the base 350 and in a direction directed to the feeder 369*b*, is turned at the feeder 369*b* and another one of the heat generators 360 extends in the longitudinal direction of the base 350 and in an opposite direction. The feeder 369*b*, having a decreased resistance value, is disposed on another lateral end of the base 350 in the longitudinal direction thereof and extended in the short direction of the base 350. Each of the heat generators 360, the electrodes 360*c* and 360*d*, and the feeders 369*a*, 369*b*, and 369*c* is produced by screen printing to have a predetermined line width and a predetermined thickness.

The heat generators 360 are produced as below. Silver (Ag) or silver-palladium (AgPd) and glass powder and the like are mixed into paste. The paste coats the base 350 by screen printing or the like. Thereafter, the base 350 is subject to firing. For example, each of the heat generators 360 has a resistance value of 10Ω at an ambient temperature. Alternatively, the heat generators 360 may be made of a resistive material such as a silver alloy (AgPt) and ruthenium oxide ($RuO_2$).

A thin overcoat layer or the insulating layer 370 covers a surface of each of the heat generators 360 and the feeders 369*a*, 369*b*, and 369*c*. The insulating layer 370 attains insulation between the fixing belt 310 and the heat generators 360 and between the fixing belt 310 and the feeders 369*a*, 369*b*, and 369*c* while facilitating sliding of the fixing belt 310 over the insulating layer 370.

For example, the insulating layer 370 is made of heat resistant glass and has a thickness of 75 micrometers. The heat generators 360 heat the fixing belt 310 that contacts the insulating layer 370 by conduction of heat, increasing the temperature of the fixing belt 310 so that the fixing belt 310 heats and fixes the unfixed toner image on the sheet P conveyed through the fixing nip SN.

The inner circumferential surface of the fixing belt 310 is applied with a lubricant that facilitates sliding of the fixing belt 310 over the heater 303. The lubricant is silicone oil having heat resistance and a predetermined kinetic viscosity. For example, the lubricant is preferably amino-modified silicone oil having an enhanced wettability or methylphenyl silicone oil having an enhanced heat resistance. In order to improve heat resistance, an antioxidant in a slight amount may be added to the silicone oil.

For example, the lubricant may be grease, dimethyl silicone oil, organometallic salt-added dimethyl silicone oil, hindered amine-added dimethyl silicone oil, dimethyl silicone oil added with organometallic salt and hindered amine, methylphenyl silicone oil, organometallic salt-added amino-modified silicone oil, hindered amine-added amino-modified silicone oil, perfluoro polyether oil, or the like.

As illustrated in FIG. 3, an elastic body 375 is disposed downstream from and abutted on the heater 303 (e.g., the laminated heater) that incorporates the heat generators 360 in the sheet conveyance direction DP or the rotation direction D310 of the fixing belt 310. The elastic body 375 is rectangular in cross section and extended in a longitudinal direction of the heater 303 as illustrated in FIGS. 5A, 5B, and 5C.

The elastic body 375 is made of silicone rubber having an Asker C hardness in a range of from 40 degrees to 50 degrees and a predetermined thickness in a range of from 2 mm to 3 mm, for example. In order to improve fitting to a height of the toner image on the sheet P, the elastic body 375 may be made of silicone sponge, heat resistant nonwoven fabric, felt, or the like that has the Asker C hardness in a range of from 20 degrees to 40 degrees.

Figure 5A:
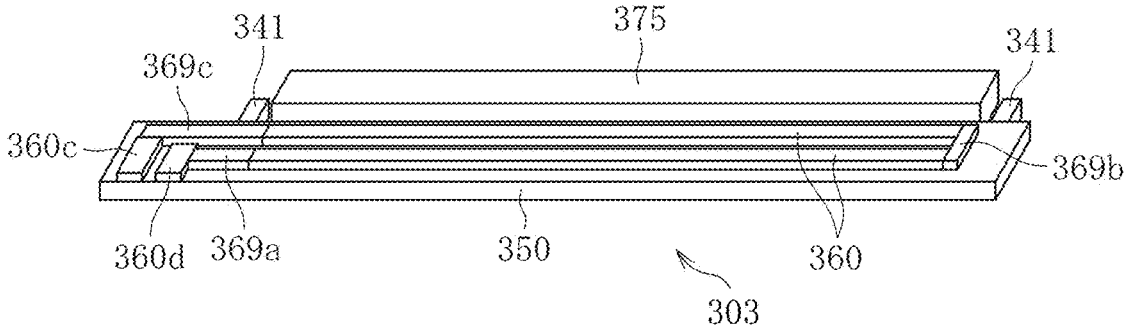
FIG. 5A is a perspective view of the heater depicted in FIG. 4A and an elastic body incorporated in the fixing device depicted in FIG. 3.
Figure 5B:
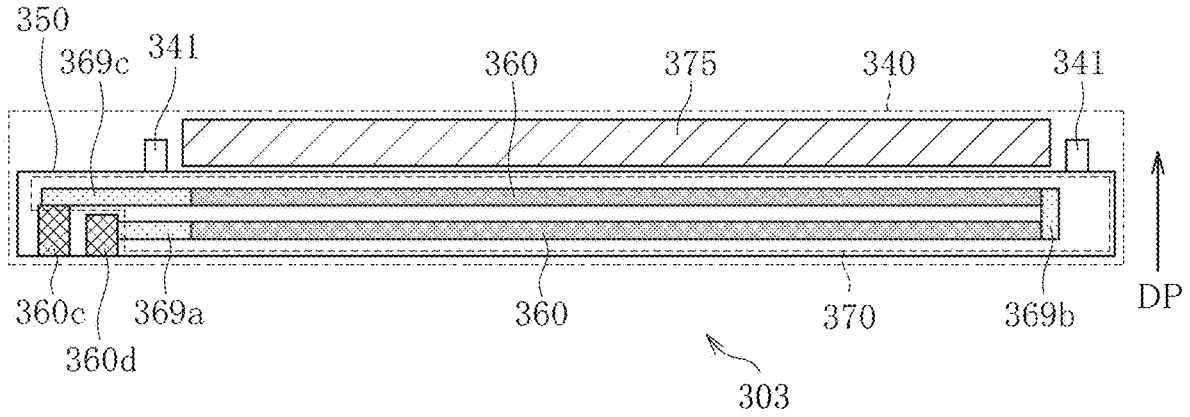
FIG. 5B is a plan view of the heater and the elastic body depicted in FIG. 5A.
Figure 5C:
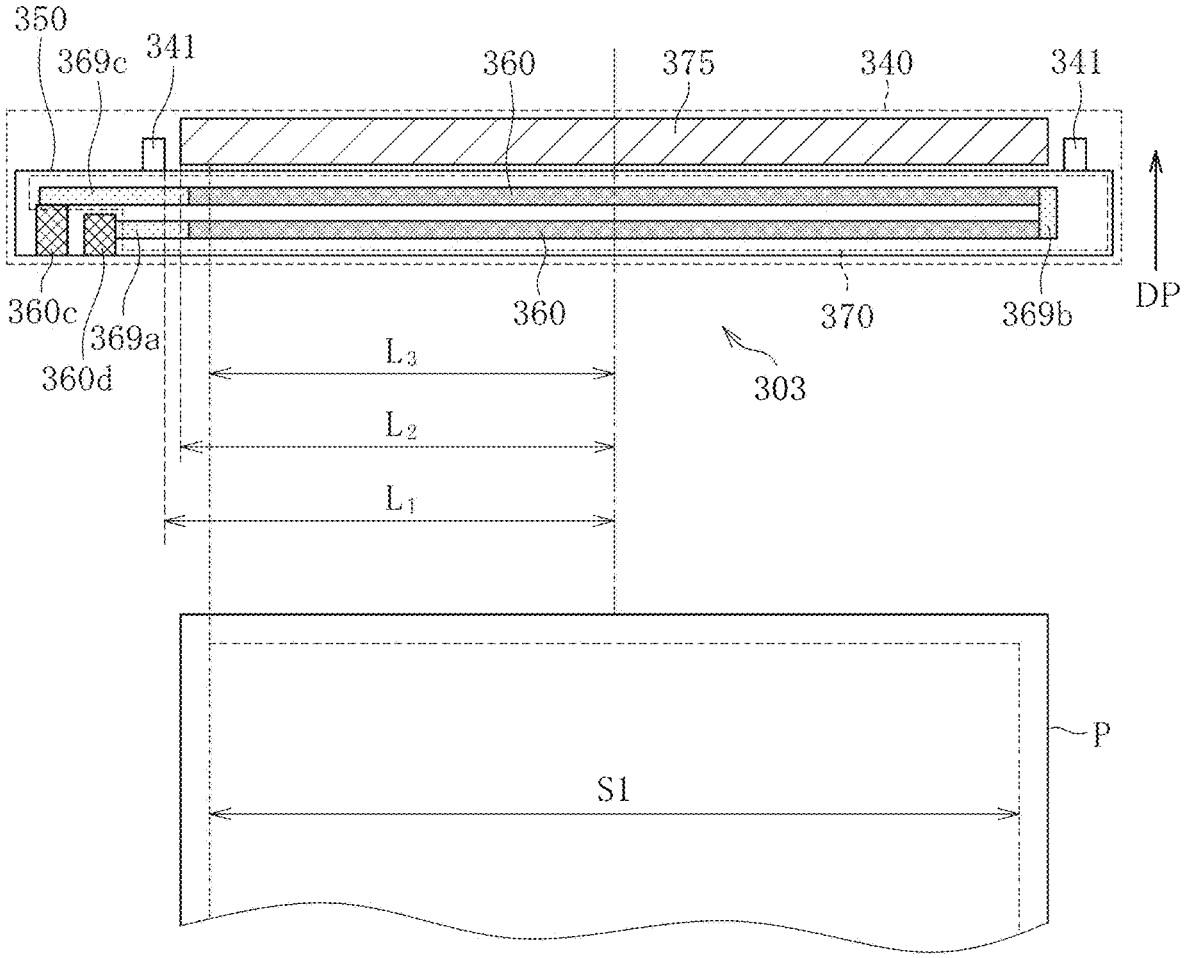
FIG. 5C is a plan view of the heater and the elastic body depicted in FIG. 5A and a sheet disposed opposite the heater and the elastic body.

As illustrated in FIGS. 5A, 5B, and 5C, a pair of motion restrictors 341, that is, a left motion restrictor and a right motion restrictor, is disposed on both lateral ends of the holder 340 in a longitudinal direction thereof, respectively. Each of the motion restrictors 341 is a rectangular parallelepiped that is combined or molded with a surface of the holder 340. A downstream portion of the base 350 in the sheet conveyance direction DP or the rotation direction D310 of the fixing belt 310 contacts the motion restrictors 341 at both lateral ends of the base 350 in the longitudinal direction thereof.

While the fixing belt 310 rotates in the rotation direction D310 in a state in which the fixing belt 310 slides over the heater 303 frictionally, the fixing belt 310 exerts a downstream force in the rotation direction D310 to the base 350 and the heat generators 360 of the heater 303. With the construction of the fixing device 300R depicted in FIG. 1, that restricts motion of the base 350R insufficiently, the base 350R may shift downstream in the sheet conveyance direction DR. Accordingly, an upstream end of the elastic body 375R in the sheet conveyance direction DR may be bulged and deformed. A part of the slide sheet may be lifted and deformed into creases. Consequently, the deformed upstream end of the elastic body 375R and the deformed part of the slide sheet may exert pressure greater than predetermined pressure to a part of a fixing nip formed between the fixing belt 310R and the pressure roller 320R, thus increasing abrasion of the inner circumferential surface of the fixing belt 310R and driving torque of the fixing belt 310R, which may result in faulty fixing.

To address this circumstance, the fixing device 300 according to this embodiment includes the motion restrictors 341 that prevent the base 350 from shifting downstream in the sheet conveyance direction DP or the rotation direction D310 of the fixing belt 310. Since the motion restrictors 341 are disposed on both lateral ends of the holder 340 in the longitudinal direction thereof, respectively, at least one of the base 350 and the heat generators 360 is disposed close to the elastic body 375. For example, while the motion restrictors 341 restrict downstream motion of the heater 303 in the sheet conveyance direction DP or the rotation direction D310 of the fixing belt 310, the motion restrictors 341 prevent a gap between the heater 303 and the elastic body 375 from being produced.

Accordingly, while the fixing belt 310 rotates in the rotation direction D310, the fixing belt 310 slides from the heater 303 to the elastic body 375 smoothly. Additionally, no gap is provided between the base 350 and the elastic body 375, preventing a decreased load applied to the fixing nip SN, that might be caused by the gap between the base 350 and the elastic body 375. If the decreased load is applied to a part of the fixing nip SN, the fixing belt 310 is subject to increase in abrasion of the inner circumferential surface of the fixing belt 310 and increase in driving torque.

For example, if the fixing belt 310 has a substantially decreased rigidity like a PI rubberless belt, the motion restrictors 341 disposed outboard from the elastic body 375 in the longitudinal direction of the holder 340 decrease the gap between the heater 303 and the elastic body 375 to almost zero. Accordingly, the motion restrictors 341 suppress deformation of the elastic body 375 due to motion of the heater 303 while suppressing decrease in the load applied to the fixing nip SN.

FIGS. 5B and 5C illustrate the gap between the heater 303 and the elastic body 375. However, the gap between the heater 303 and the elastic body 375 may be zero substantially. For example, an upstream end of the elastic body 375 protrudes upstream beyond an upstream end of each of the motion restrictors 341, that is, the left motion restrictor and the right motion restrictor in FIGS. 5B and 5C, in the sheet conveyance direction DP or the rotation direction D310 of the fixing belt 310 by about 0.2 mm at most. Accordingly, as the upstream end of the elastic body 375 contacts the heater 303, the upstream end of the elastic body 375 is compressed lightly, causing the gap between the heater 303 and the elastic body 375 to be substantially zero throughout an entire width of the elastic body 375 in a longitudinal direction thereof.

Alternatively, the motion restrictors 341 may not be provided like the pair of motion restrictors 341 depicted in FIGS. 5A, 5B, and 5C. For example, the motion restrictor 341 is disposed on one lateral end of the holder 340 in the longitudinal direction thereof. Another lateral end of the holder 340 in the longitudinal direction thereof may mount a motion restrictor of a different type, such as a combination of a boss and a boss hole, that is interposed between the holder 340 and the base 350.

A description is provided of a positional relation between the motion restrictors 341 and an imaging span S1 on a sheet P, that bears a toner image.

As illustrated in FIG. 5C, an inboard end of each of the motion restrictors 341 is disposed outboard from the imaging span S1 in a width direction of the sheet P, that is, the axial direction of the fixing belt 310. Each lateral end of the elastic body 375 is interposed between each lateral end of the imaging span S1 and each inboard end of the motion restrictor 341 in the axial direction of the fixing belt 310.

For example, a distance $L_1$ is from a center of the heater 303 to the inboard end of the motion restrictor 341 in the axial direction of the fixing belt 310. A distance $L_2$ is from the center of the heater 303 to the lateral end of the elastic body 375 in the axial direction of the fixing belt 310. A distance $L_3$ is from the center of the heater 303 to the lateral end of the imaging span S1 in the axial direction of the fixing belt 310. The distances $L_1$, $L_2$, and $L_3$ define a relation of $L_1>L_2>L_3$.

With the relation between the distances $L_1$, $L_2$, and $L_3$, the elastic body 375 applies sufficient pressure to the sheet P at a downstream half part of the fixing nip SN throughout an entire width of the imaging span S1 in the axial direction of the fixing belt 310. Thus, the fixing device 300 prevents faulty mixing of colors (e.g., black, yellow, magenta, and cyan) and faulty fixing when the fixing device 300 fixes a color toner image on a sheet P. Additionally, the fixing device 300 prevents the motion restrictors 341 from interfering with the sheet P. Alternatively, the distance $L_1$ may be equal to the distance $L_2$ so that the motion restrictor 341 restricts the lateral end of the elastic body 375 in the axial direction of the fixing belt 310.

Figure 6A:
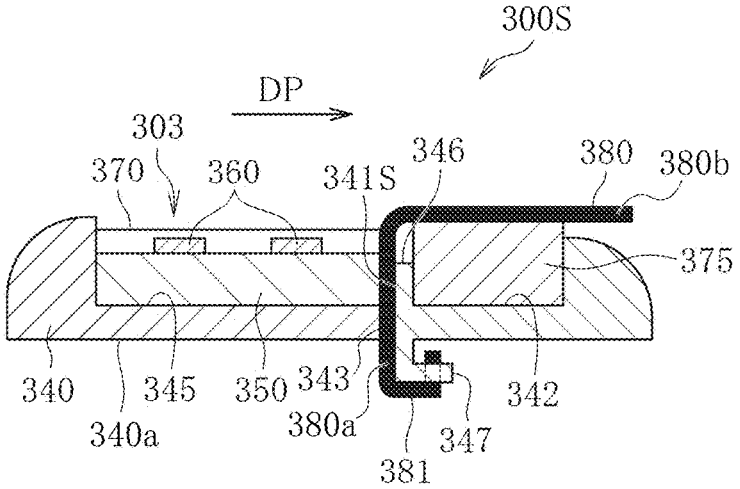
FIG. 6A is a cross-sectional view of the heater, the elastic body, and a holder, incorporated in the fixing device depicted in FIG. 3, that holds the heater and the elastic body.

As illustrated in FIG. 6A, the holder 340 includes a recess 342 (e.g., a groove) that accommodates and positions the elastic body 375. A slide sheet 380 covers a surface of the elastic body 375. For example, the surface of the elastic body 375 is disposed opposite the pressure roller 320. An upstream end 380*a* of the slide sheet 380 in the sheet conveyance direction DP or the rotation direction D310 of the fixing belt 310 protrudes beyond the rear face 340*a* of the holder 340 in a state in which the upstream end 380*a* of the slide sheet 380 is sandwiched between the base 350 and the elastic body 375. The rear face 340*a* faces the stay 330.

The slide sheet 380 is a non-porous sheet made of heat resistant resin. The non-porous sheet has no holes impregnated with a lubricant. The heat resistant resin has sufficient heat resistance against a fixing temperature at which a toner image is fixed on a sheet P. For example, the heat resistant resin includes thermosetting polyimide, thermoplastic polyimide, polyamide, polyamide imide, silicone resin, and fluororesin.

A downstream end 380*b* of the slide sheet 380 in the sheet conveyance direction DP or the rotation direction D310 of the fixing belt 310 is disposed opposite a downstream end of the holder 340 in the sheet conveyance direction DP or the rotation direction D310 of the fixing belt 310 in a state in which the downstream end 380*b* of the slide sheet 380 is sandwiched between the fixing belt 310 and the elastic body 375. The downstream end 380*b* of the slide sheet 380 is not a fixed end fixed to the holder 340 but a free end not fixed to the holder 340, facilitating installation of the slide sheet 380. The area of the slide sheet 380 is also minimized, reducing manufacturing costs.

Figure 6B:
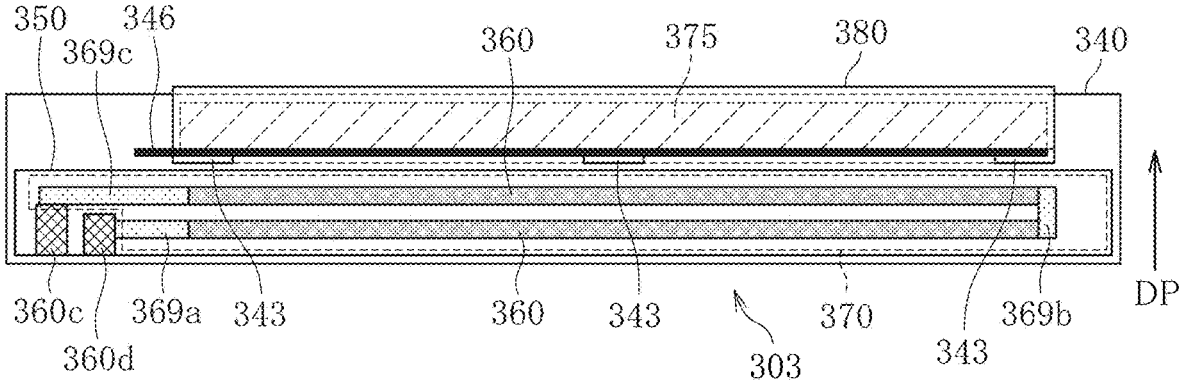
FIG. 6B is a plan view of the heater, the elastic body, and the holder depicted in FIG. 6A.

As illustrated in FIGS. 6A and 6B, a fixing device 300S includes a partition wall 346 interposed between the recess 345 accommodating the base 350 and the recess 342 accommodating the elastic body 375. The partition wall 346 includes a motion restrictor 341S that defines an upstream side face of the partition wall 346 in the sheet conveyance direction DP or the rotation direction D310 of the fixing belt 310. Accordingly, the upstream end 380*a* of the slide sheet 380 in the sheet conveyance direction DP or the rotation direction D310 of the fixing belt 310 engages an engaging claw 347 mounted on the rear face 340*a* of the holder 340.

For example, according to this embodiment, the slide sheet 380 includes protrusions 381 serving as upstream ends of the slide sheet 380 in the sheet conveyance direction DP or the rotation direction D310 of the fixing belt 310. The protrusions 381 are disposed at a plurality of positions (e.g., at three positions of both lateral ends and a center) of the slide sheet 380 in a longitudinal direction thereof. The holder 340 includes slits 343 disposed upstream from the partition wall 346 in the sheet conveyance direction DP or the rotation direction D310 of the fixing belt 310 and disposed in proximity to a base of the partition wall 346. The protrusions 381 protrude beyond the rear face 340*a* of the holder 340 through the slits 343, respectively. An engaging hole disposed in a tip of each of the protrusions 381 engages the engaging claw 347. Accordingly, the slide sheet 380 is installed into the fixing device 300S readily. The partition wall 346 improves positioning and attachment of the elastic body 375.

The partition wall 346 produces a gap between the insulating layer 370 of the heater 303 and the elastic body 375 due to a thickness of the partition wall 346. However, if the fixing belt 310 has a substantial rigidity, the fixing belt 310 does not decrease the load applied to the fixing nip SN. For example, the fixing belt 310 including a rubber layer or a metal base has the substantial rigidity. Accordingly, even if the slight gap is provided between the insulating layer 370 of the heater 303 and the elastic body 375, the rigidity of the fixing belt 310 retains a shape of the fixing belt 310, preventing decrease in the load applied to the fixing nip SN.

A height of the elastic body 375 is preferably greater than a height of the insulating layer 370 of the heater 303 slightly. For example, an upper face of the elastic body 375 in FIG. 6A protrudes toward the pressure roller 320 beyond a surface of the insulating layer 370. Thus, the elastic body 375 exerts substantial pressure to the fixing belt 310.

With the fixing device 300S employing the heater 303 as the laminated heater, the laminated heater may not exert sufficient pressure to toner melted and softened at the downstream half part of the fixing nip SN in the rotation direction D310 of the fixing belt 310. To address this circumstance, as described above, the elastic body 375 protrudes toward the pressure roller 320 beyond the heater 303, preventing faulty mixing of colors (e.g., black, yellow, magenta, and cyan) and faulty fixing when the fixing device 300S fixes a color toner image on a sheet P, for example.

Conversely, the height of the insulating layer 370 of the heater 303 may be higher than the height of the elastic body 375. Accordingly, the elastic body 375 does not dam the lubricant applied on the inner circumferential surface of the fixing belt 310 at a downstream end of the heater 303 in the sheet conveyance direction DP or the rotation direction D310 of the fixing belt 310, preventing the lubricant from moving and leaking outboard in the axial direction of the fixing belt 310.

Figure 7:
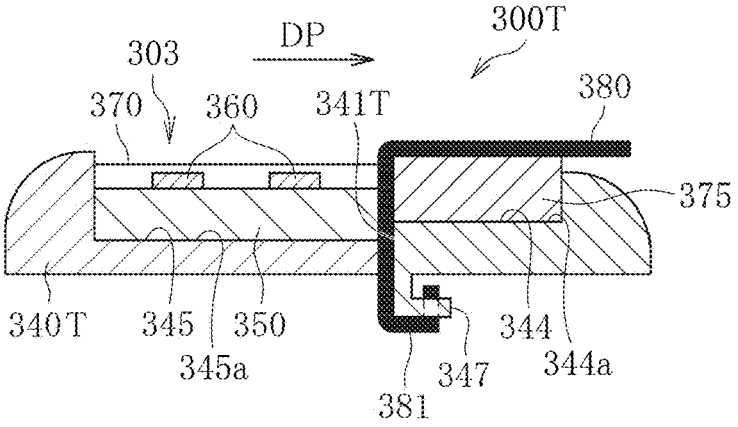
FIG. 7 is a cross-sectional view of the heater and the elastic body depicted in FIG. 6A and a holder as a variation of the holder depicted in FIG. 6A.

As illustrated in FIG. 7, a fixing device 300T includes the heater 303 that has a sufficiently great thickness and a holder 340T. The holder 340T includes a recess 344 (e.g., a groove) that accommodates the elastic body 375. The recess 344 includes an upstream end in the sheet conveyance direction DP or the rotation direction D310 of the fixing belt 310, that is open. The recess 344 includes a bottom face 344*a* serving as a second attachment face that mounts the elastic body 375. The recess 345 includes a bottom face 345*a* serving as a first attachment face disposed upstream from the second attachment face in the sheet conveyance direction DP or the rotation direction D310 of the fixing belt 310. The bottom face 345*a* mounts the heater 303. A step is provided between the bottom face 344*a* of the recess 344 and the bottom face 345*a* of the recess 345. The step serves as a motion restrictor 341T. In the fixing device 300T also, no gap is produced between the heater 303 and the elastic body 375. Accordingly, the motion restrictor 341T suppresses deformation of the elastic body 375 due to motion of the heater 303 while suppressing decrease in the load applied to the fixing nip SN.

Figure 8:
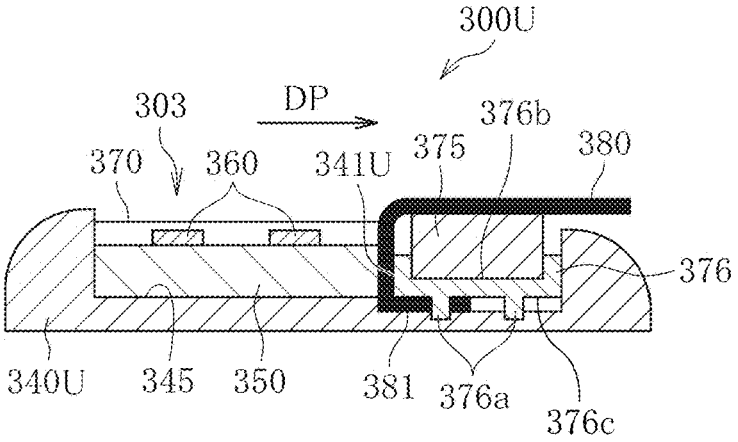
FIG. 8 is a cross-sectional view of the heater and the elastic body depicted in FIG. 6A and a holder as another variation of the holder depicted in FIG. 6A.

As illustrated in FIG. 8, a fixing device 300U includes an elastic body holder 376 serving as a second holding portion and a holder 340U serving as a first holding portion. The elastic body holder 376 includes a recess 376*b* (e.g., a groove) that accommodates the elastic body 375. The elastic body holder 376 includes an upstream side face in the sheet conveyance direction DP or the rotation direction D310 of the fixing belt 310, that serves as a motion restrictor 341U. The elastic body holder 376 attached with the elastic body 375 in advance is attached to the holder 340U serving as the first holding portion efficiently and readily.

The elastic body holder 376 includes a bottom 376*c* (e.g., a lower face) that mounts projections 376*a* that engage the holder 340U. The projections 376*a* engage the protrusions 381 of the slide sheet 380 disposed at the plurality of positions (e.g., at the three positions of both lateral ends and the center) of the slide sheet 380 in the longitudinal direction thereof, respectively. The projections 376*a* that engage the holder 340U also serve as engagements that engage the elastic body holder 376 with the holder 340U.

Figure 9:
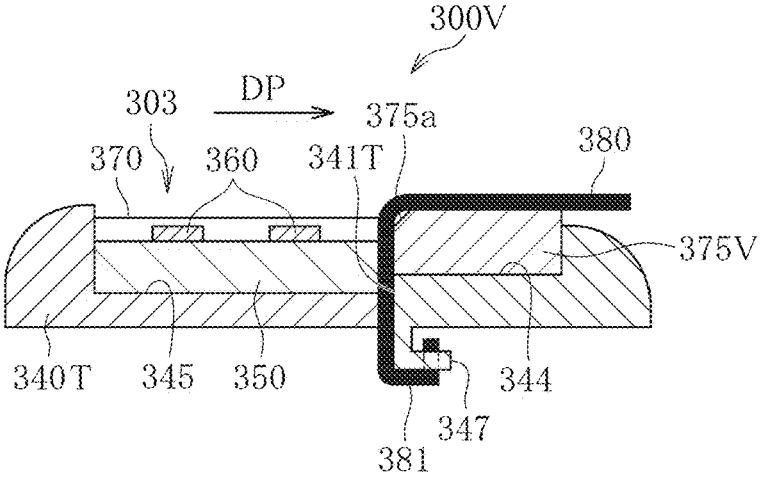
FIG. 9 is a cross-sectional view of the heater and the holder depicted in FIG. 7 and an elastic body as a variation of the elastic body depicted in FIG. 7, illustrating a chamfer of the elastic body.

As illustrated in FIG. 9, a fixing device 300V includes an elastic body 375V that includes a chamfer 375*a* disposed at a corner of the elastic body 375V. The chamfer 375*a* is produced by C-chamfering or R-chamfering. Accordingly, the slide sheet 380 contacts and fits the chamfer 375*a*, being immune from being lifted from the elastic body 375V and deformed into creases.

The above describes the embodiments of the present disclosure. However, the technology of the present disclosure is not limited to the embodiments described above and is modified within the scope of the present disclosure. For example, according to the embodiments described above, the heating device 304 is applied to a fixing device (e.g., the fixing devices 300, 300S, 300T, 300U, and 300V) for fixing a toner image on a sheet P, that is installed in an image forming apparatus (e.g., the image forming apparatus 100) for forming the toner image on the sheet P by electrophotography. However, the heating device 304 according to the embodiments of the present disclosure is also applicable to devices other than the fixing device. For example, the heating device 304 is also applicable to a heating device that corrects curling of a recording medium used in an inkjet printer.

A description is provided of advantages of a heating device (e.g., the heating device 304).

As illustrated in FIGS. 3 and 5C, a heating device (e.g., the heating device 304) includes an endless rotator (e.g., the fixing belt 310), a heater (e.g., the heater 303), an elastic body (e.g., the elastic bodies 375 and 375V), a holder (e.g., the holders 340, 340T, and 340U), a support (e.g., the stay 330), a pressure rotator (e.g., the pressure roller 320), and a motion restrictor (e.g., the motion restrictors 341, 341S, 341T, and 341U).

The endless rotator rotates in a rotation direction (e.g., the rotation direction D310). The heater contacts an inner circumferential surface of the endless rotator and extends in an axial direction (e.g., a width direction) of the endless rotator. The elastic body contacts the inner circumferential surface of the endless rotator and is disposed downstream from the heater in the rotation direction of the endless rotator. The holder holds the heater and the elastic body. The support supports the holder. The pressure rotator is disposed opposite the heater and the elastic body via the endless rotator to form a nip (e.g., the fixing nip SN) between the endless rotator and the pressure rotator, through which a recording medium (e.g., a sheet P) bearing an image is conveyed. The motion restrictor is mounted on the holder. The motion restrictor restricts motion of the heater downstream in the rotation direction of the endless rotator.

With the heating device according to the embodiments of the present disclosure, the motion restrictor mounted on the holder restricts motion of the heater, preventing deformation of the elastic body that might be caused by motion of the heater and resultant increase in abrasion and driving torque of the endless rotator.

Further, the motion restrictor restricts motion of a heat generator (e.g., the heat generators 360) of a fixing device (e.g., the fixing devices 300, 300S, 300T, 300U, and 300V), preventing increase in abrasion and driving torque of a fixing rotator (e.g., the fixing belt 310).

According to the embodiments described above, the fixing belt 310 serves as an endless rotator. Alternatively, a fixing film, a fixing sleeve, or the like may be used as an endless rotator. Further, the pressure roller 320 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A heating device comprising:

an endless rotator configured to rotate in a rotation direction;

a heater configured to contact an inner circumferential surface of the endless rotator and extend in an axial direction of the endless rotator;

an elastic body configured to contact the inner circumferential surface of the endless rotator and disposed downstream from the heater in the rotation direction of the endless rotator;

a holder configured to hold the heater and the elastic body;

a pressure rotator disposed opposite the heater and the elastic body via the endless rotator to form a nip between the endless rotator and the pressure rotator; and a motion restrictor mounted on the holder, the motion restrictor configured to restrict motion of the heater downstream in the rotation direction of the endless rotator, wherein the motion restrictor is disposed outboard from the elastic body in the axial direction of the endless rotator.

2. The heating device according to claim 1, wherein the motion restrictor includes a partition wall interposed between the heater and the elastic body.

3. The heating device according to claim 1, wherein the elastic body protrudes toward the pressure rotator beyond the heater.

4. The heating device according to claim 1, wherein the holder includes:

a first attachment face configured to mount the heater; and a second attachment face configured to mount the elastic body and protrude toward the pressure rotator beyond the first attachment face, and wherein the motion restrictor includes a step defined by the first attachment face and the second attachment face.

5. The heating device according to claim 1, further comprising a slide sheet configured to cover a surface of the elastic body, the surface disposed opposite the pressure rotator.

6. The heating device according to claim 5, further comprising a support configured to support the holder.

7. The heating device according to claim 6, wherein the slide sheet includes an upstream end in the rotation direction of the endless rotator, wherein the holder includes:

a slit;

a rear face configured to face the support; and an engaging claw mounted on the rear face, and wherein the upstream end of the slide sheet engages the engaging claw through the slit.

8. The heating device according to claim 5, wherein the slide sheet includes a downstream end in the rotation direction of the endless rotator, the downstream end not fixed to the holder.

9. The heating device according to claim 5, wherein the elastic body includes a chamfer configured to contact the slide sheet.

10. The heating device according to claim 1, wherein the elastic body is made of silicone rubber.

11. The heating device according to claim 1, wherein the endless rotator includes an endless belt.

12. The heating device according to claim 1, wherein the holder includes:

a first holding portion configured to hold the heater; and a second holding portion configured to hold the elastic body, the second holding portion held by the first holding portion.

13. The heating device according to claim 12, further comprising a slide sheet configured to cover a surface of the elastic body, the surface disposed opposite the pressure rotator, wherein the slide sheet includes an upstream end in the rotation direction of the endless rotator, and wherein the second holding portion includes:

a bottom; and a projection mounted on the bottom, the projection configured to engage the upstream end of the slide sheet.

14. The heating device according to claim 13, wherein the projection of the second holding portion engages the first holding portion.

15. A fixing device comprising:

an endless rotator configured to rotate in a rotation direction;

a heater configured to contact an inner circumferential surface of the endless rotator and extend in an axial direction of the endless rotator;

an elastic body configured to contact the inner circumferential surface of the endless rotator and disposed downstream from the heater in the rotation direction of the endless rotator;

a holder configured to hold the heater and the elastic body;

a pressure rotator disposed opposite the heater and the elastic body via the endless rotator to form a nip between the endless rotator and the pressure rotator, the nip through which a recording medium bearing a developer is conveyed; and a motion restrictor mounted on the holder, the motion restrictor configured to restrict motion of the heater downstream in the rotation direction of the endless rotator, wherein the motion restrictor is disposed outboard from the elastic body in the axial direction of the endless rotator.

16. An image forming apparatus comprising:

an image forming device configured to form an image; and a fixing device configured to fix the image on a recording medium, the fixing device including:

an endless rotator configured to rotate in a rotation direction;

a heater configured to contact an inner circumferential surface of the endless rotator and extend in an axial direction of the endless rotator;

an elastic body configured to contact the inner circumferential surface of the endless rotator and disposed downstream from the heater in the rotation direction of the endless rotator;

a holder configured to hold the heater and the elastic body;

a pressure rotator disposed opposite the heater and the elastic body via the endless rotator to form a nip between the endless rotator and the pressure rotator, the nip through which the recording medium bearing the image is conveyed; and a motion restrictor mounted on the holder, the motion restrictor configured to restrict motion of the heater downstream in the rotation direction of the endless rotator, wherein the motion restrictor is disposed outboard from the elastic body in the axial direction of the endless rotator.

* * * * *